US006715471B2

(12) United States Patent
Hiraiwa et al.

(10) Patent No.: US 6,715,471 B2
(45) Date of Patent: Apr. 6, 2004

(54) ELECTRIC FUEL PUMP

(75) Inventors: Masaru Hiraiwa, Tokyo (JP); Shigeki Kanamaru, Tokyo (JP); Michihiro Hayashi, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/003,694

(22) Filed: Dec. 6, 2001

(65) Prior Publication Data

US 2002/0085930 A1 Jul. 4, 2002

(30) Foreign Application Priority Data

Dec. 7, 2000 (JP) ..... 2000-372506
Jun. 18, 2001 (JP) ..... 2001-183521

(51) Int. Cl.[7] ..... F02M 37/04
(52) U.S. Cl. ..... 123/497; 123/510; 137/543.17
(58) Field of Search ..... 123/497, 510, 123/506, 514, 495; 137/543.17, 540; 337/417; 251/337; 417/366

(56) References Cited

U.S. PATENT DOCUMENTS 3,756,273 A * 9/1973 Hengesbach ..... 137/540
3,911,950 A * 10/1975 Lowe et al. ..... 137/543.17
4,665,943 A * 5/1987 Medvick et al. ..... 137/543.17
4,889,151 A * 12/1989 Oten ..... 137/71
5,013,222 A * 5/1991 Sokol et al. ..... 417/366
5,044,344 A * 9/1991 Tuckey et al. ..... 123/497
5,391,062 A 2/1995 Yoshioka
5,630,399 A * 5/1997 Nomura et al. ..... 123/467
5,655,504 A * 8/1997 Iwai ..... 123/511
5,762,047 A 6/1998 Yoshioka et al.
5,794,915 A * 8/1998 Shimizu et al. ..... 251/127
6,290,205 B1 * 9/2001 Haga et al. ..... 251/129.15

* cited by examiner

*Primary Examiner*—Carl S. Miller
(74) *Attorney, Agent, or Firm*—Sughrue Mion, PLLC

(57) ABSTRACT

An electric fuel pump comprising a pump casing assembly having a fuel inlet port and an outlet port and a rotary member driven by an electric motor disposed within the pump casing assembly for pumping fuel from the outlet port. A fuel discharge port supplies the fuel from the outlet port to an engine, and a pressure regulator is disposed for regulating the pressure of the fuel to be discharged from the fuel discharge port. The pressure regulator regulates the pressure of the fuel from the outlet port by returning the fuel to the vicinity of the inlet port when the pressure of the fuel from the outlet port is equal to or higher than a predetermined pressure.

9 Claims, 6 Drawing Sheets

ELECTRIC FUEL PUMP

CROSS REFERENCE TO RELATED APPLICATION

This application is based on Application No. 2000-372506, filed in Japan on Dec. 7, 2000 and Application No. 2001-183521, filed in Japan on Jun. 18, 2001, the contents of which are hereby incorporated by reference.

BACKGROUND OF THE INVENTION

This invention relates to an electric fuel pump disposed within a fuel tank for a vehicular internal combustion engine for pumping fuel within the fuel tank to the engine.

FIG. 7 is a longitudinal sectional view of a conventional electric fuel pump disclosed in Japanese Patent Publication No. 7-3239, for example, and FIG. 8 is a graph showing the performance of the conventional electric fuel pump.

In these figures, an electric fuel pump comprises a pump casing assembly 1 that comprises a pump casing main body 2 and a cover 3. The pump casing assembly 1 accommodates an impeller 4 which is a disc-shaped rotary member having a row of vanes 5 disposed along the outer circumference. An arc-shaped pump flow path 7 is formed to extend along the row of the vanes 5 of the impeller 4 and to straddle between both of the pump casing main body 2 and the cover 3. The cover 3 is provided at a position corresponding to one end of the pump flow path 7 with a suction port 8 that extends from one side of the impeller 4 to open downwardly as viewed in FIG. 7, and the pump main body 2 is provided with a discharge port 9 that extends from the other side of the impeller 4 to open upwardly as viewed in FIG. 7.

The impeller 4 has inserted into its center a central shaft 6 of a rotor 16 of an electric motor 15, the rotor 16 being rotatably supported at the central shaft 6 by a bearing 17 and a bearing 18 disposed in the pump casing main body 2 and the bracket 24, respectively.

An end cover 19 made of a molded thermoplastic resin, for example, is connected to the pump casing assembly 1 through a cylindrical yoke 20 of the electric motor 15. Permanent magnets 25 are circumferentially arranged on the inner circumference of the yoke 20 and the rotor 16 is disposed inside of the circumferentially arranged permanent magnets 25.

Defined between the pump casing assembly 1 and the end cover 19 and within the yoke 20 is a fuel chamber 21 for accommodating the fuel discharged from the discharge port 9. The fuel chamber 21 is communicated with a fuel exhaust port 23 defined in the end face of the end cover 19 through a check valve 22 disposed in a communicating passage for restricting the flow direction of the fuel. A feed brush 27 is disposed for supplying an electric current to the windings of the rotor 16 through a commutator 26.

In the conventional electric fuel pump having the above-described structure, when an electric current is supplied to the windings (not shown) of the rotor 16 of the electric motor 15 through the feed brush 27 and the commutator 26, the impeller 4 is driven to rotate clockwise direction (as shown by an arrow in FIG. 8) to cause the fuel to be suctioned from the suction port 8 into one end of the pump flow path 7 and increased in pressure as it flows through the pump flow path 7 in the clockwise direction. Then the fuel enters into the fuel chamber 21 from the discharge port 9 at the other end of the flow path 7 and flows through the check valve 22 and finally discharged from the discharge port 23.

The performance (shown in FIG. 9) of the electric fuel pump can be represented by a characteristic diagram expressed by the pressure (P) of the fuel discharged from the electric fuel plotted against the axis of ordinate and the discharge amount (Q) of the fuel discharged from the electric fuel pump and the electric current (I) consumed by the electric fuel pump plotted against the axis of abscissa. The fuel discharged from the fuel discharge port 23 of the electric fuel pump is supplied to the vehicular internal combustion engine (not shown) after it is regulated to a predetermined pressure (P1) by an unillustrated pressure regulator.

It is to be noted that the pressure regulator (not shown) is a separate structure independent from the electric fuel pump as disclosed in Japanese Patent Laid-Open No. 8-177681. In such the arrangement, when the fuel discharged from the fuel exhaust port 23 of the electric fuel pump is regulated in fuel pressure by a fuel pressure regulator to P1 (shown in FIG. 9), the electric fuel pump operates continuously at a discharge rate of Q1 and at a consumption current of I1. An excessive amount of fuel Q1−q, which is a fuel amount that was discharged from the pump at the discharge rate Q1 but would not be consumed by the engine operated at a fuel consumption rate q, is not supplied to the engine but fed back to the fuel tank from the pressure regulator.

As has been described, the conventional electric fuel pump is arranged such that it always supplies a fuel amount of Q1 including the excessive fuel amount that is required by the engine q, so that the current consumption I1 of the fuel pump is large. Therefore, a large load is imposed on a battery of the vehicle and the fuel amount discharged from the fuel pump is decreased because some of the fuel evaporates within the pump due to the Jourl's heat generated at the windings of the rotor 16.

SUMMARY OF THE INVENTION

Accordingly, an object of the present invention is to provide an electric fuel pump that is free from the above problems of the conventional electric fuel pump.

Another object of the invention is to provide an electric fuel pump in which the pump can be operated at a small current corresponding to the fuel consumption of the engine, thus decreasing the load on the battery, preventing the decrease of the fuel discharge amount due to the evaporation of the fuel by the Jourl's heat at the rotor windings.

With the above objects in view, the present invention resides in an electric fuel pump comprising a pump casing assembly having a fuel inlet port and an outlet port and a rotary member driven by an electric motor disposed within the pump casing assembly for sucking fuel from the fuel inlet port and discharging it from the outlet port. A fuel discharge port is disposed for supplying the fuel discharged from the outlet port to an internal combustion engine, and a pressure regulator is disposed for regulating the pressure of the fuel to be discharged from the fuel discharge port. The pressure regulator regulates the pressure of the fuel discharged from the fuel outlet port by returning the fuel to the vicinity of the inlet port when the pressure of the fuel discharged from the outlet port is equal to or higher than a predetermined pressure.

The pressure regulator may be disposed within a regulator receptacle hole of the pump casing assembly.

The pressure regulator may comprise a valve for controlling the flow rate of the fuel to be returned to an area in the vicinity of the inlet port on the basis of the pressure of the fuel discharged from the outlet port, a spring for determining the pressure at which the valve is opened and closed, and a spring holder for holding the spring.

The electric fuel pump may further comprise an elastic member disposed on the surface of the valve which abuts against a main body of the pump casing assembly.

The valve may comprise an elastic member having an engaging projection portion and a spring receptacle having an engaging recess portion, the engaging projection portion being fitted into the engaging recess portion to join the elastic member and the spring receptacle into an integral structure.

The spring may comprise a coil spring, one end of which being fitted onto the valve and the other end of which being fitted into the spring holder to join the elastic member and the spring receptacle into an integral structure.

The spring holder may be secured at a predetermined position in the inner circumferential surface of a bore for accommodating the pressure regulator.

The spring holder may have a notch formed at its circumferential edge portion.

The rotary member may be an impeller having vanes at its outer circumference.

The electric motor may comprise a rotor having inserted therein a central shaft that engages with the rotary member, a bearing for rotatably supporting the central shaft, a pair of permanent magnets concentrically disposed at the outer circumference of the rotor and a commutator and current feed brush for supplying an electric current to a rotor winding.

BRIEF DESCRIPTION OF THE DRAWINGS

The present invention will become more readily apparent from the following detailed description of the preferred embodiments of the present invention taken in conjunction with the accompanying drawings, in which.

DESCRIPTION OF THE PREFERRED EMBODIMENTS

Figure 1:
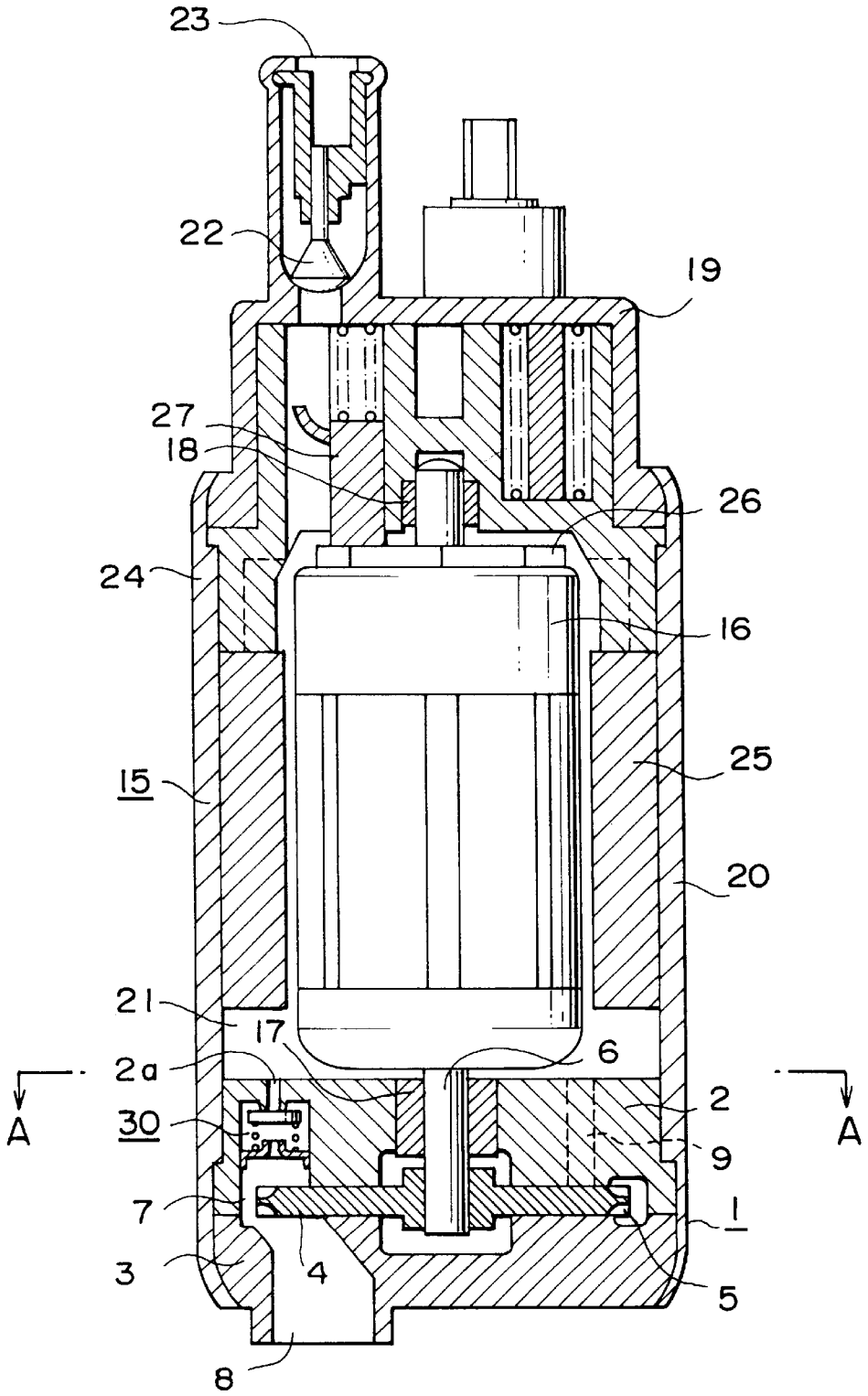
FIG. 1 is a longitudinal sectional view of an electric fuel pump of the present invention.
Figure 2:
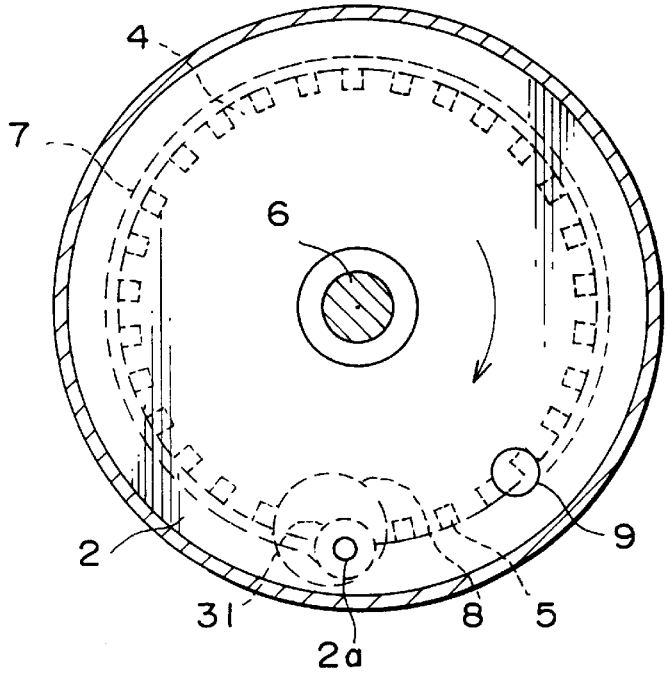
FIG. 2 is a sectional view taken along line A—A of FIG. 1.
Figure 3:
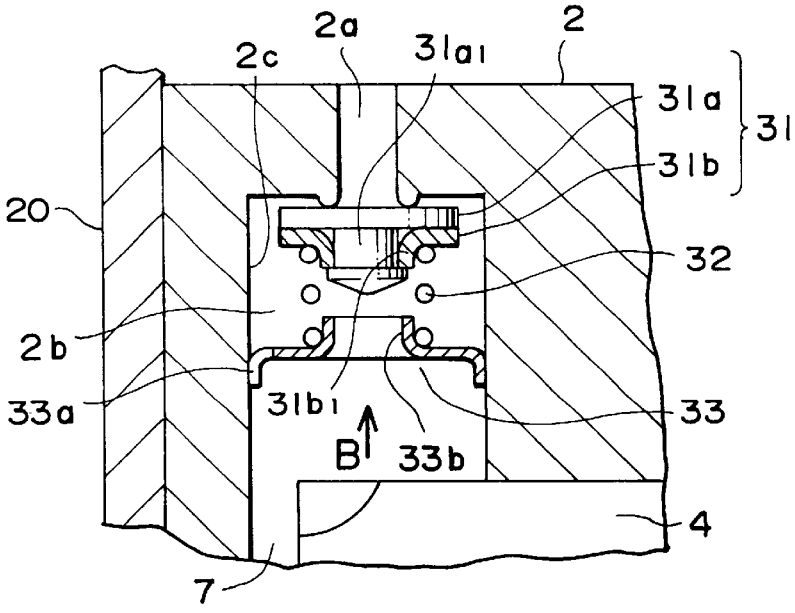
FIG. 3 is an enlarged sectional view showing the pressure regulator.
Figure 4:
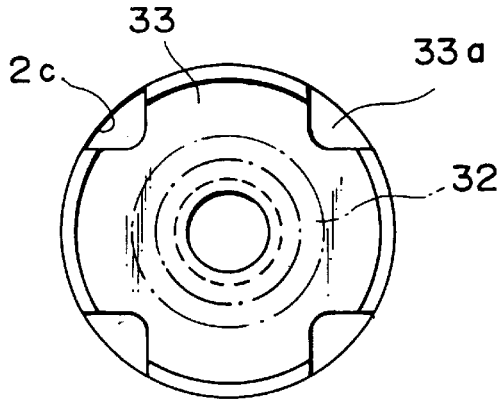
FIG. 4 is an enlarged sectional view as viewed in the direction of the arrow B in FIG. 3.

FIG. 1 is a longitudinal sectional view of an electric fuel pump of the present invention, FIG. 2 is a sectional view taken along line A—A of FIG. 1, FIG. 3 is an enlarged sectional view showing the pressure regulator, and FIG. 4 is an enlarged sectional view as viewed in the direction of the arrow B in FIG. 3.

In FIGS. 1 to 4, the electric fuel pump comprises a pump casing assembly 1 composed of the pump casing main body 2 and a cover 3. Disposed within the pump casing assembly 1 is an impeller 4 which is a disc-shaped rotary member having a vane portion 5 disposed along the outer circumferential portion. Along this vane portion 5 of the impeller 4, an arcuate belt-shaped pump flow path 7 is formed in the pump casing main body 2 and the cover 3 to straddle therebetween. The cover 3 is provided at a position corresponding to one end of the pump flow path 7 with a suction port 8 that extends from one side of the impeller 4 to open downwardly as viewed in FIG. 1, and the pump main body 2 is provided with a discharge port 9 that extends from the other side of the impeller 4 to open upwardly as viewed in FIG. 1.

The impeller 4 has inserted into its center a central shaft 6 of a rotor 16 of an electric motor 15, the rotor 16 being rotatably supported at the central shaft 6 by a bearing 17 and a bearing 18 disposed in the pump casing main body 2 and the bracket 24, respectively.

An end cover 19 made of a molded thermoplastic resin, for example, is connected to the pump casing assembly 1 through a cylindrical yoke 20 of the electric motor 15. Permanent magnets 25 are circumferentially arranged on the inner circumference of the yoke 20 and the rotor 16 is disposed inside of the circumferentially arranged permanent magnets 25.

Defined between the pump casing assembly 1 and the end cover 19 and within the yoke 20 is a fuel chamber 21 for accommodating the fuel discharged from the discharge port 9. The fuel chamber 21 is communicated with a fuel exhaust port 23 defined in the end face of the end cover 19 through a check valve 22 disposed in a communicating passage for restricting the flow direction of the fuel. A feed brush 27 is disposed for supplying an electric current to the windings of the rotor 16 through a commutator 26.

As best shown in FIGS. 1 and 3, a fuel return passage 2*a* is provided in the pump casing main body 2 of the pump casing assembly 1 to open at its one end to the fuel chamber 21. The other end of the fuel return passage 2*a* is connected to a bore 2*b* for accommodating the pressure regulator therein which has a diameter larger than that of the fuel return passage 2*a* and an inner 0 circumferential surface 2*c*. Thus, the fuel chamber 21 and the pump flow path 7 in the vicinity of the inlet port 8 are communicated through the fuel return passage 2*a* and the regulator accommodating bore 2*b*.

Figure 5:
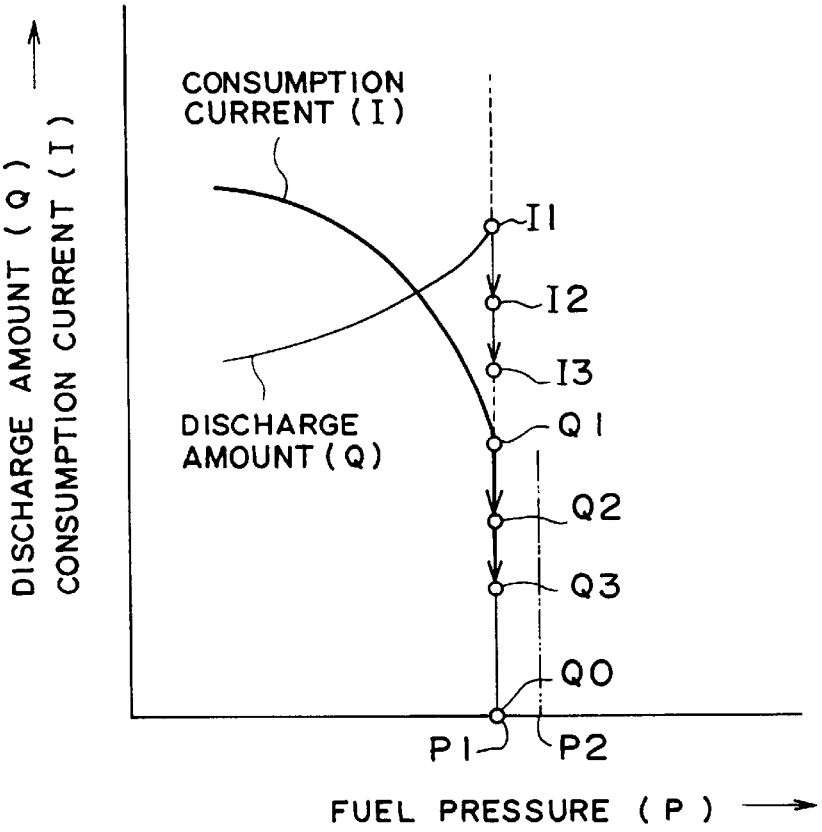
FIG. 5 is a graph showing characteristic curves of performance of the electric fuel pump of the embodiment 1 of the present invention.

The regulator accommodating bore 2*b* has disposed therein a pressure regulator 30, which comprises a valve 31 which usually closes a fuel return passage 2*a* and which opens to return the fuel to in the area in the vicinity of the inlet port 8 when the pressure discharge into the fuel chamber 21 from the outlet port 9 exceeds a predetermined value such as pressure P1 shown in FIG. 5, a spring 32 which determines the pressure at which the valve 31 opens or closes and an annular spring holder 33 fitted on the inner circumferential surface 2*c* of the pressure regulator accommodating bore 2*b* for holding the spring 32.

The valve 31 is composed of an elastic member 31*a* and a spring holder 31*b* combined with the elastic member 31*a*. The elastic member 31*a* disposed to abut against the lip portion of the second end of the fuel return passage 2*a* of the pump casing main body 2 is made of molded rubber for example in order to establish a hermetic seal. The spring holder 31*b* abutting against the spring 32 is made of a high rigidity material such as a sheet of a metal such as stainless steel or a resin such as a phenol resin so that it does not deform under the spring force of the spring 32.

The elastic member 31*a* is provided with an anchor-shaped engaging projection 31*a*1, which is inserted to fit into the inner circumference of an engaging boss portion 31*b*1 formed by burring or the like in the spring holder 31*b*, whereby the elastic member 31*a* and the spring holder 31*b* are assembled into an integral structure. The elastic member 31*a* may be a film-like material applied to cover the spring holder 31*b*.

The function of the valve 31 is to prevent leakage of the fuel within the fuel chamber 21 into the area in the vicinity of the inlet port 8 when the valve 31 is urged against the pump casing main body 2 when the pressure within the fuel chamber 21 is not greater than the predetermined pressure, so that it may equally be a single member having a smooth flat surface made of a metal or resin sheet.

The spring 32 is a coil spring formed from a stainless wire, but may be a leaf spring or the like as long as the valve 31 and the spring holder 33 can be biased to be separated from each other As best shown in FIG. 4, the spring holder 33 is provided with four notches 33*a* in the outer circumference arranged at equal intervals and the a burring portion 33*b* at its central portion. These notches 33*a* provide passages for allowing the fuel to flow therethrough to return to the inlet port 8 and decreases the rigidity of the spring holder 33 so that the spring holder 33 can be easily inserted into the inner circumferential surface 2*c* of the regulator accommodating bore 2*b*. The burring portion 33*b* is for holding the spring 32.

The steps of assembling the valve 31, the spring 32 and the spring holder 33 within the regulator accommodating bore 2*b* to constitute the pressure regulator 30 will now be described.

The spring 32 is elastically fitted at its one end over the outer circumference of the boss portion 31*b*1 of the spring holder 31*b*. Since the inner diameter of the spring 32 smaller than the outer diameter of the engaging boss portion 31*b*1, the spring 32 fits on the spring holder 31*b* under pressure and is held thereon.

Then, the other end of the spring 32 is placed over the outer circumference of the burring portin 33*b* of the spring holder 33. Since the inner diameter of the spring 32 is smaller than the outer diameter of the burring portion 33*b*, the spring holder 33 is held by the spring 32 in pressure fit, whereby the valve 31 and the spring holder 33 are integrally connected together by the spring 32.

Then, the assembly of the valve 31, the spring 32 and the spring holder 33 is inserted into the regulator accommodating bore 2*b* with the outer circumference of the spring holder 33 slid along the inner circumference 2*c* of the bore 2*b* until the spring holder 33 is supported at a predetermined position as shown in FIG. 3 to constitute the pressure regulator 30.

The operation of the electric fuel pump thus constructed will now be described in conjunction with FIGS. 1 to 5. The description will be made first as to when a vehicular internal combustion engine having the electric fuel pump mounted thereon is stopped, for example, and no fuel is consumed.

When an electric current is supplied to the windings (not shown) of the rotor 16 of the electric motor 15 through the supply brush 27 and the commutator 26, the rotor 16 is rotated to cause the rotation (FIG. 2) of the impeller 4 in clockwise direction through the central shaft 6.

As the vanes 5 disposed at the outer circumference portion of the impeller 4 rotate along the arcuated belt-shaped pump flow path 7, swirling flows generate in the vane portion 5 which increases the kinetic energy as it circulates to generate a pumping action (the inlet port 8 and its vicinity is negative while the outlet port 9 and its vicinity is positive). This causes the fuel to be sucked into one end of the pump flow path 7 from the inlet port 8 and to be pressure-increased as it flows in the clockwise direction through the pump flow path 7 and to be discharged into the fuel chamber 21 from the other end of the pump flow path 7 through the outlet port 9.

The pressure of the fuel supplied to the fuel chamber 21 is quickly increased because it cannot be supplied to the unillustrated vehicular internal combustion engine from the fuel discharge port 23 through the check valve 22 which is in a state that can be said to be closed.

When the fuel pressure within the fuel chamber 21 reaches at P1 (FIG. 5), the valve 31 opens to return the fuel within the fuel chamber 21 to the area close to the inlet port 8 through the opening of the valve 31, the regulator accommodating bore 2*b* and the recesses 33*a* of the spring holder 33, whereby the fuel pressure within the fuel chamber 21 is maintained at P1 without increasing the fuel pressure. The amount of discharge at this time is Q0.

The fuel pressure within the fuel chamber 21 can be adjusted by suitably adjusting the position of the spring holder 33 on the inner circumference 2*c* of the regulator accommodating bore 2*b*. For example, the fuel pressure can be set high (P2 in FIG. 5) by pushing the spring holder 33 into the regulator accommodating bore 2*b* (upwardly as viewed in FIG. 3).

The description will now be made as to the operation of the electric fuel pump when the fuel consumption amount is changed while a vehicular internal combustion engine is being operated and the fuel is being supplied from the fuel pump.

It is assumed that the electric fuel pump is operated at a fuel pressure P1, a fuel discharge amount Q1 that is supplied from the fuel discharge port 23 to the engine and a consumption of electric current I1 (Q1 and I1 shown in FIG. 5). In this embodiment of the invention, the arrangement is such that the valve 31 is in the closed state and all of the fuel discharged from the outlet port 9 is supplied from the fuel chamber 21 to the engine from the fuel discharge port 23 through the check valve 22. However, the arrangement may be such that the fuel from the fuel chamber 21 is only partially returned to the area close to the inlet port 8 through the opening of the valve 31, the regulator accommodating bore 2*b* and the notches 33*a* provided in the spring holder 33.

When the fuel consumption amount of the engine, which is the fuel amount that is supplied from the fuel discharge port 23, decreases from Q1 to Q2, the fuel pressure within the fuel chamber 21 tends to increase. However, since the valve 31 opens to permit the fuel within the fuel chamber 21 to return from the fuel return passage 2*a* to the area in the vicinity of the inlet port 8 through the opening portion of the valve 31, the regulator accommodating bore 2*b* and the notches 33*a* provided in the spring holder 33, so that the fuel pressure within the fuel chamber 21 is maintained at P1.

When the pressurized fuel from the fuel chamber 21 is returned to the inlet port 8, the negative pressure generated at the area close to the inlet port 8 is alleviated and the load torque applied to the rotor 16 through the central shaft 6 is decreased, whereby the current consumption of the electric motor 15 (electric fuel pump) is decreased from I1 to I2.

When the fuel consumption of the engine, which is the fuel amount that is supplied from the fuel discharge port 23, further decreases to Q3, the amount of the fuel returned to the area closed to the inlet port 8 through the fuel return passage 2*a*, the valve opening portion 31, the regulator accommodation bore 2*b* and through the notches 33*a* provided in the spring holder 33 increases. This causes the negative pressure generated in the area close to the inlet port 8 to be further alleviated to further decrease the load torque that has been applied to the rotor 16 through the central shaft 6, whereby the consumed current of the electric motor 15 (electric fuel pump) decreases to 13.

When the fuel consumption of the engine, which is the fuel amount that is supplied from the fuel discharge port 23, increases to Q2, the fuel pressure within the fuel chamber 21 decreases to decrease the amount of fuel that is returned from the fuel chamber 21 to the area close to the inlet port 8 through the fuel return passage 2*a*, the opening portion of the valve 31, the regulator accommodation bore 2*b* and through the notches 33*a* formed in the spring holder 33, whereby the negative pressure generated in the area close to the inlet port 8 is alleviated to cause the fuel discharged to the fuel chamber 21 through the outlet port 9 to be increased and to increase the fuel pressure within the fuel chamber 21 to maintain the fuel pressure at P1.

As has been described, according to the electric fuel pump of the present invention, an electric fuel pump can be provided in which the pump can be operated at a small current corresponding to the fuel consumption of the engine, thus decreasing the load on the battery, preventing the decrease of the fuel discharge amount due to the evaporation of the fuel by the Jourl's heat at the rotor windings.

While the rotary member for generating a fuel pressure in this embodiment is of the non-displacement type employing a vane disc having a plurality of vanes around its outer circumference, the present invention is equally applicable to an arrangement of the displacement type employing a trochoid gear shown in Japanese Patent Laid-Open No. 2000-265972. However, the advantageous results of decreasing the consumption current obtained by the present invention is greater in the non-displacement type than the displacement type because the former is higher in the consumption current.

Also, while the electric motor 15 of the above embodiment has been described as being a direct current motor including the commutator 26 and the supply brush 27 making sliding contact with the commutator 26, a brushless motor such as that disclosed in Japanese Patent Laid-Open No. 2000-228890 may be used. However, the advantageous results that wearing of the supply brush 27 and the commutator 26 can be alleviated due to the decreased consumption current when the present invention is applied to the d.c. motor.

Also, while the pressure regulator 30 is accommodated within the regulator accommodating bore 2*b* formed in the pump casing assembly 1, it may also be positioned within the electric fuel pump or on the outer circumferential surface of the yoke 20 of the electric fuel pump as long as it allows the fuel from the outlet port 9 to return to the area close to the inlet port 8.

Figure 6:
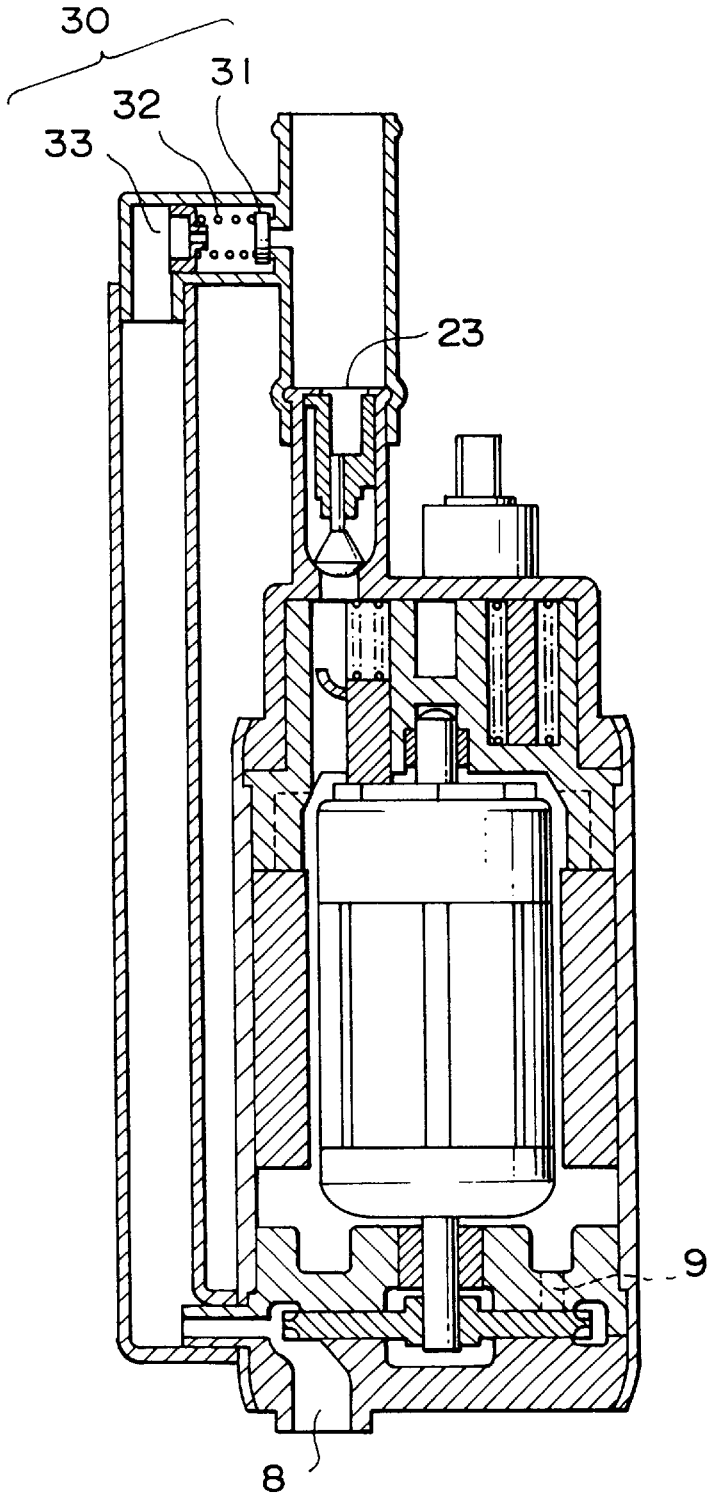
FIG. 6 is a longitudinal sectional view of an electric fuel pump of anther embodiment of the present invention.
Figure 7:
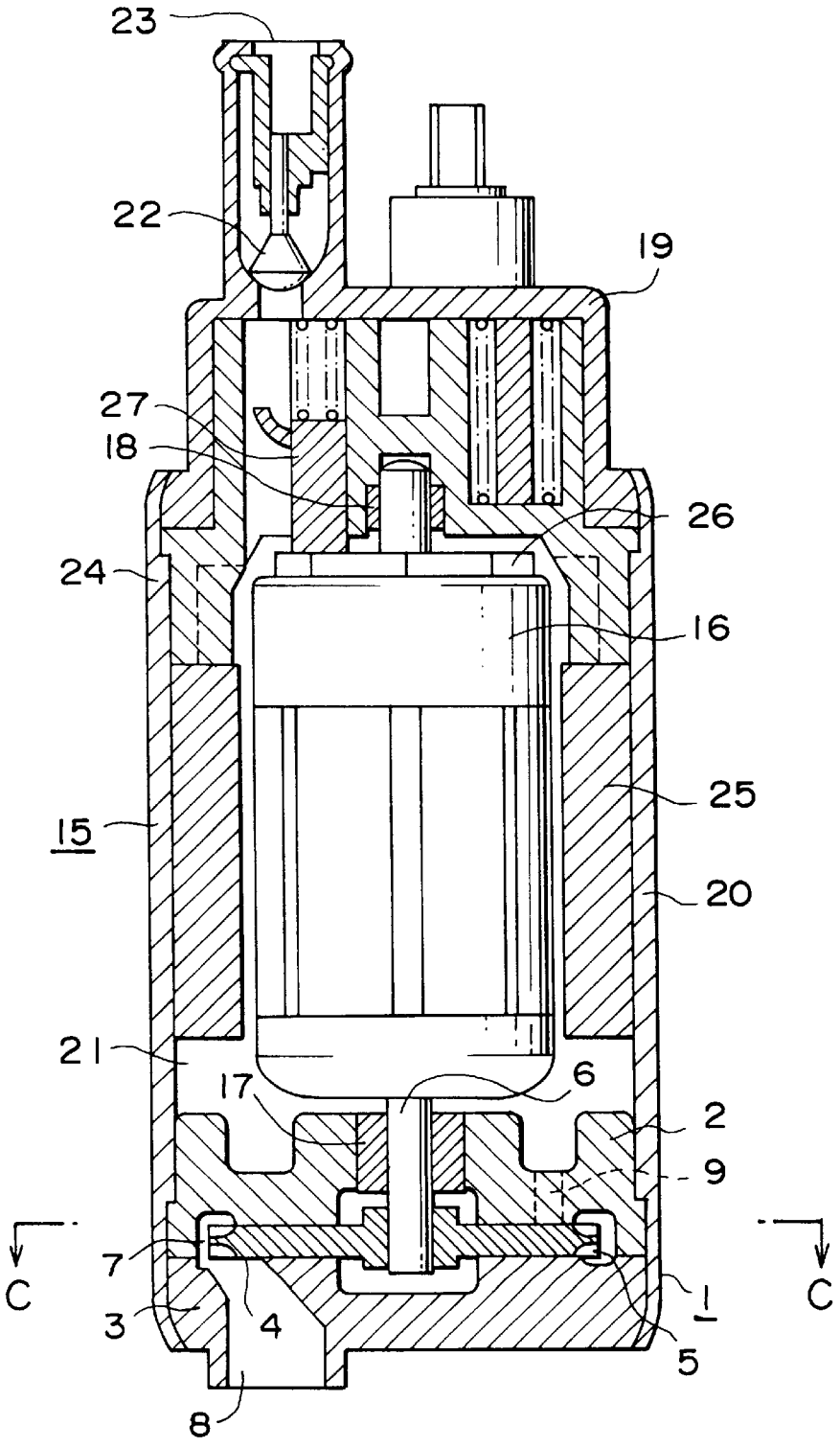
FIG. 7 PRIOR ART
FIG. 7 is a sectional view showing the conventional electric fuel pump.
Figure 8:
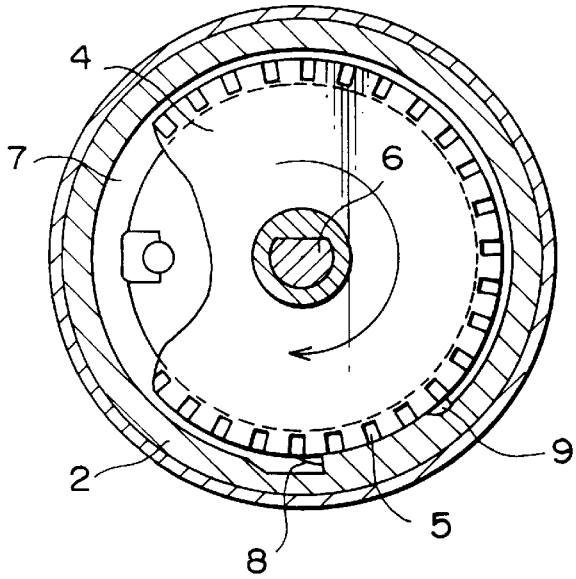
FIG. 8 PRIOR ART
FIG. 8 is a sectional view taken along line C—C of FIG. 7.
Figure 9:
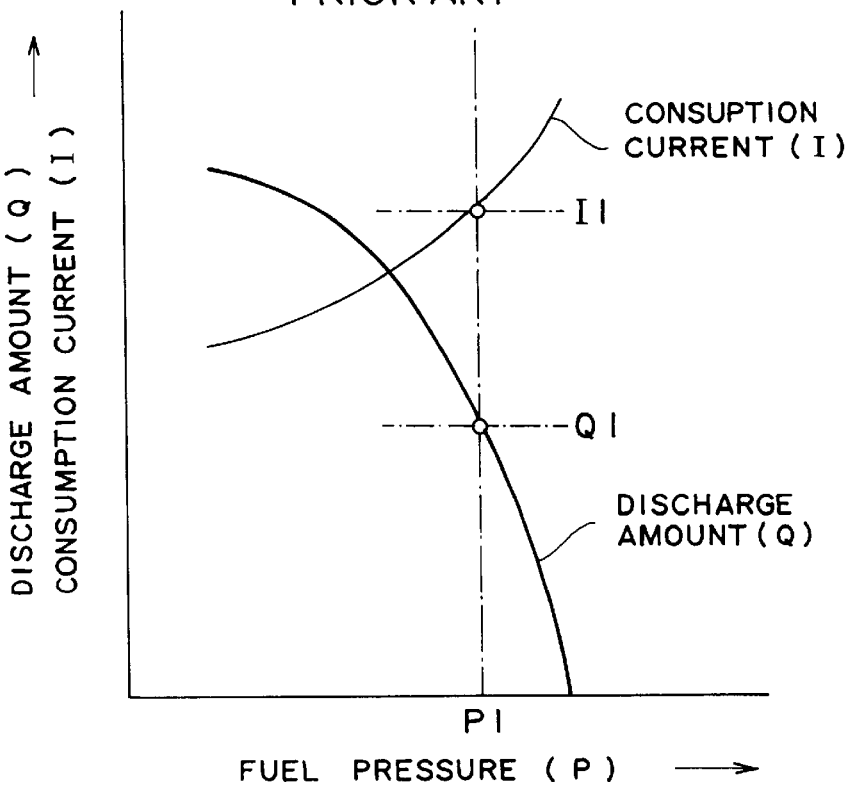
FIG. 9 PRIOR ART
FIG. 9 is a graph showing characteristic curves of performance of the conventional electric fuel pump.

Further, while the pressure regulator 30 may be connected to the fuel discharge port 23 so that the fuel may return to the inlet port 8 as shown in FIG. 6, a fuel pump system that is advantageous in that the space for mounting the pressure regulator 30 therein is minimized can be obtained by accommodating the pressure regulator 30 within the electric fuel pump.

As has been described, the electric fuel pump of the present invention comprises a pump casing assembly having a fuel inlet port and an outlet port and a rotary member driven by an electric motor disposed within the pump casing assembly for sucking fuel from the fuel inlet port and discharging it from the outlet port, a fuel discharge port disposed for supplying the fuel discharged from the outlet port to an internal combustion engine, and a pressure regulator disposed for regulating the pressure of the fuel to be discharged from the fuel discharge port. The pressure regulator regulates the pressure of the fuel discharged from the fuel outlet port by returning the fuel to the vicinity of the inlet port when the pressure of the fuel discharged from the outlet port is equal to or higher than a predetermined pressure. whereby the pressure of the fuel discharged from the fuel outlet port is regulated. Therefore, the fuel discharged from the outlet port is returned to the area close to the inlet port when the fuel consumption of the engine decreases, thereby decreasing the load torque on the rotor and decreasing the consumption current of the electric motor (electric fuel pump), so that the load on the battery can be reduced and the evaporation of the fuel due to the Jourl's heat at the windings of the coil can be prevented.

Also, the pressure regulator is disposed within a regulator accommodation bore of the pump casing assembly within the electric fuel pump, so that a fuel pump system in which the mounting space for the pressure regulator is decreased can be obtained.

Also, the pressure regulator comprises a valve for controlling the flow rate of the fuel to be returned to an area in the vicinity of the inlet port on the basis of the pressure of the fuel discharged from the outlet port, a spring for determining the pressure at which the valve is opened and closed, and a spring holder for holding the spring, so that the fuel pressure can be precisely regulated with a simple structure.

Also, the electric fuel pump further comprises an elastic member disposed on the surface of the valve which abuts against a main body of the pump casing assembly, so that a good hermetic seal is established between the pump casing main body and the elastic member in the state where the valve is urged against the pump casing main body (i.e., when the pressure within the fuel chamber is not more than the predetermined pressure), whereby no fuel leaks from the fuel chamber to the area in the vicinity of the inlet port and the regulating ability as a pressure regulator is improved.

Also, the valve comprises an elastic member having an engaging projection portion and a spring receptacle having an engaging recess portion, the engaging projection portion being fitted into the engaging recess portion to join the elastic member and the spring receptacle into an integral structure, and the spring may comprise a coil spring, one end of which being fitted onto the valve and the other end of which being fitted into the spring holder to join the elastic member and the spring receptacle into an integral structure. Therefore, the valve, the spring and the spring holder are made integral, realizing easy assembly into the regulator accommodating bore.

Also, the spring holder is secured at a predetermined position in the inner circumferential surface of a bore for accommodating the pressure regulator, so that the spring which determines the pressure at which the valve opens and closes can be securely set, allowing precise setting of the fuel pressure.

Also, the spring holder has a notch formed at its circumferential edge portion, so that the fuel smoothly flows from the fuel chamber to the area close to the inlet port and insertion of the spring holder into the regulator accommodating bore is easy.

Also, the rotary member is an impeller having vanes at its outer circumference, and is applied to the non-displacement type which is large in the motor consumption current, so that the consumption current can be significantly decreased and the prevention of the fuel evaporation due to the Jourle's heat in the rotor windings can be much improved.

Also, the electric motor comprises a rotor having inserted therein a central shaft that engages with the rotary member, a bearing for rotatably supporting the central shaft, a pair of permanent magnets concentrically disposed at the outer circumference of the rotor, and a commutator and current feed brush for supplying an electric current to a rotor winding. Therefore, the consumption current of the electric motor can be decreased and the frictional wears of the commutator and the supply brush constituting the electric motor.

What is claimed is:

1. An electric fuel pump comprising:

a pump casing assembly having a fuel inlet port and an outlet port;

a rotary member disposed within said pump casing assembly for sucking fuel from said fuel inlet port and discharging it from said outlet port;

a fuel discharge port for supplying the fuel discharged from said outlet port to an internal combustion engine; and a pressure regulator for regulating pressure of the fuel to be discharged from said fuel discharge port;

said pressure regulator being disposed within a regulator receptacle hole of said pump casing assembly and said pressure regulator regulating the pressure of the fuel discharged from said fuel outlet port by returning the fuel via said regulator receptacle hole to a pump flow passage when the pressure of the fuel discharged from said outlet port is equal to or higher than a predetermined pressure, wherein the pump flow passage extends along a periphery of said rotary member such that the fuel pressure within the pump flow passage is substantially greater than zero due to fuel pressure generated by said rotary member which sucks fuel from said fuel inlet port and discharges it from said outlet port.

2. An electric fuel pump as claimed in claim 1, wherein said pressure regulator comprises a valve for controlling the flow rate of the fuel to be returned to an area in the vicinity of the inlet port on the basis of the pressure of the fuel discharged from the outlet port, a spring for determining the pressure at which said valve is opened and closed, and a spring holder for holding said spring.

3. An electric fuel pump as claim in claim 2, further comprising an elastic member disposed on the surface of said valve which abuts against a main body of said pump casing assembly.

4. An electric pump as claimed in claim 2, wherein said valve comprises an elastic member having an engaging projection portion and a spring receptacle having an engaging recess portion, said engaging projection portion being fitted into said engaging recess portion to join said elastic member and said receptacle into an integral structure.

5. An electric fuel pump as claimed in claim 2, wherein said spring comprises a coil spring, one end of which being fitted onto the valve and the other end of which being fitted into the spring holder.

6. An electric fuel pump as claimed in claim 2, wherein said spring holder is secured at a predetermined position in the inner circumferential surface of a bore for accommodating said pressure regulator.

7. An electric fuel pump as claimed in claimed in claim 6, wherein said spring holder has a notch formed at its circumferential edge portion.

8. An electric fuel pump as claimed in claim 1, wherein said rotary member is an impeller having vanes at its outer circumference.

9. An electric fuel pump as claimed in claim 1, wherein said electric motor comprises a rotor having inserted therein a central shaft that engages with said rotary member, a bearing for rotatably supporting said central shaft, a pair of permanent magnets concentrically disposed at the outer circumference of said rotor and a commutator and current feed brush for supplying an electric current to a rotor winding.

* * * * *